US007849530B2

(12) United States Patent
Hendricks

(10) Patent No.: US 7,849,530 B2
(45) Date of Patent: Dec. 14, 2010

(54) WASTE-WATER HEAT RECOVERY SYSTEM

(76) Inventor: Craig Hendricks, P.O. Box 903, Stayton, OR (US) 97383

( * ) Notice: Subject to any disclaimer, the term of this patent is extended or adjusted under 35 U.S.C. 154(b) by 1100 days.

(21) Appl. No.: 11/539,954

(22) Filed: Oct. 10, 2006

(65) Prior Publication Data

US 2007/0089230 A1 Apr. 26, 2007

Related U.S. Application Data

(60) Provisional application No. 60/729,904, filed on Oct. 25, 2005.

(51) Int. Cl.
*A47K 3/022* (2006.01)

(52) U.S. Cl. ..... 4/596; 4/661; 4/597; 4/598

(58) Field of Classification Search ..... 4/596–598, 4/605, 661; 165/47, 909; 137/625.4, 625.41
See application file for complete search history.

(56) References Cited

U.S. PATENT DOCUMENTS 3,263,242 A * 8/1966 Will ..... 4/598
4,291,423 A * 9/1981 Wilson ..... 4/598
4,300,247 A 11/1981 Berg
4,304,292 A * 12/1981 Cardone et al. ..... 165/47
4,398,308 A 8/1983 Berg
4,529,032 A * 7/1985 Molitor ..... 165/47
4,542,546 A * 9/1985 Desgagnes ..... 4/598
4,821,793 A * 4/1989 Sheffield ..... 165/47
5,143,149 A * 9/1992 Kronberg ..... 165/47
5,293,654 A * 3/1994 Castwall et al. ..... 4/598
5,771,964 A 6/1998 Bae
6,016,864 A 1/2000 Bae et al.
2007/0227694 A1 * 10/2007 Cederferm ..... 4/598
2009/0173472 A1 * 7/2009 Schryver et al. ..... 165/47

* cited by examiner

*Primary Examiner*—Khoa D Huynh
(74) *Attorney, Agent, or Firm*—Peter A Haas Esquire LLC

(57) ABSTRACT

The present invention relates to a household heat recovery device and more specifically to a wastewater heat recovery unit, which absorbs residual heat from the water flowing onto the floor and down the drain of an ordinary household shower or bathtub unit. In one embodiment, the heat recovery device adapts for ease-of-use and enables quick set-up in most existing and typical showers or bathtubs without any tools and without coupling to the existing plumbing. Internal passages direct the effluent shower water through a serpentine path to a discharge drain. Over time, the heat transferred from the water to the device then radiates into the environment—thus reducing the total energy cost for a household by reducing the thermal load on the main heating unit for the household.

2 Claims, 9 Drawing Sheets

WASTE-WATER HEAT RECOVERY SYSTEM

PRIORITY CLAIM

The present application claims benefit under 35 USC Section 119(e) of U.S. Provisional Patent Application Ser. No. 60/729,904 filed on 25 Oct. 2005.

BACKGROUND

The present invention relates to a wastewater energy recovery unit and more specifically to a household shower wastewater heat recovery unit.

As petroleum-based energy sources dwindle and cost-efficient and renewable energy sources are distant, worldwide consumers are faced with ever-increasing energy costs.

Wasted energy, often in the form of heat escaping from water, is a costly problem. In the U.S., alone, an estimated 120 million homes annually waste an estimated 350 billion kilowatts of energy from hot water running down household drains. With an average cost of $0.07 per kilowatt-hour, this equates to an annual waste of $24.5 billion. For example, the average showering session uses approximately 10 gallons of water. Assuming that half of the 10 gallons used is heated 20-degrees Fahrenheit and that water is mixed with cold water during a typical shower or bath, then to heat that five gallons of water requires three kilowatts of energy. Thus, the three Kilowatts of energy ultimately is lost as water flows out the showerhead.

Latent costs to the environment are not calculated in this loss. Global warming, increased ozone, damage to aquatic life in our streams and rivers, and depleted reserves of fossil fuels are part of this unaccounted loss. More directly, the cost to human health, delicate eco-systems, and lost economic opportunity are impossible to equate in terms of lost energy or money.

Wasted energy drives a huge retrofitting market in the United States. And, the escalating cost associated with energy drives consumer demand for ever-improved devices designed to capture waste energy. To meet this increasing demand, several retailers sell devices designed to manage energy costs. For example, retailers include over 1,200 Lowes home improvement stores, 1,900 Home Depot stores, and 3,500 Walmart stores. Despite the size of this market, existing devices typically are expensive to produce and require costly and complicated installations and otherwise inadequately address the needs of the consumer for a wastewater heat-recovery device.

For example, U.S. Pat. No. 6,016,864 issued to Bae et al and U.S. Pat. No. 5,771,964 also to Bae (The Bae references) describe a heat exchanger with relatively flat fluid conduits. The Bae references incorporate a plurality of relatively flat conduits, an inlet, and an outlet adapted to exchange heat between a fluid inside the conduit and an external fluid. One important limitation: the Bae references feature heat transfer channels with a relatively small hydraulic diameter, preferably in a range of 0.01 inch to 0.20 inch and of short length compared to the supply channels. Specifically, the Bae references attempt to provide the advantages of relatively small hydraulic diameter flow paths without the pressure drops which are usually associated with such relatively small hydraulic diameter flow paths by including supply and drain channels with substantially greater cross-sectional areas than the small flow paths. Moreover, the Bae references teach that the hydraulic fluid within the conduits be isolated from the second fluid. As a result, the Bae references require considerable effort and expense to manufacture and require complicated and costly installation techniques.

U.S. Pat. Nos. 4,398,308 and 4,300,247 both to Berg describes an energy conservation system for a shower. A heat exchanger preheats incoming cold water with hot drain water. This system requires extensive in-the-wall plumbing to affect appropriate heat transfer from the wastewater to the isolated supply line.

Therefore, there remains a need for a wastewater heat recovery unit that over comes the limitations of the prior art and provides solutions to households the world-over. Such a solution must be economical to produce and require no tools to install in the home and require no in-the-wall installation. In addition, the solution should trap heat from shower wastewater as it drains from a person using the shower or directly from the effluent flow from the showerhead. Such a solution should be a "do-it-yourself" project for homeowners, be easy to remove, and easy to service, clean and maintain.

SUMMARY OF THE INVENTION

The present invention overcomes the limitations of the prior art and provides a novel solution to wasted energy in the form of lost heat from wastewater, specifically as it relates to lost hot water from household showers and baths.

In one embodiment, the present invention includes a heat-recovery system adapted for use in a home shower basin or bathtub. The system requires no tools or plumbing interfaces with the existing bathroom fixtures. It simply rests on the floor of the tub or shower. As warm water flows out of the showerhead or bath faucet, the unit collects the effluent stream of warm water and slowly releases the water out a drain. During this slow-release process the heat from the effluent stream is transferred or conducted from the water to the heat recovery system, which is made of aluminum. No tools are required to install the system. It may be placed in the tub or basin as wanted or needed, and simply taken out when not needed.

In one embodiment, the present invention includes a simple mixing valve insert that is designed to replace the existing mixing valve insert common to most shower faucets designs. The home-owner simply removes the beauty ring from the front of the shower, and using simple hand tools, removes the existing mixing valve. Then, the home-owner simply inserts the novel mixing valve insert and annular-flow ring of the present invention and replaces the handle, coupling the handle to the flow-ring, which is designed to allow the handle and mixing valve to rotate. The flow-ring is stationary and includes two quick-connect type valves. The valves enable the home-owner to insert tubing, flex-tube, or other conduit to the novel mixing valve and connect the other end to the base unit resting on the basin or tub floor. This creates a closed-loop system in the base unit and cold water from the shower faucet is then routed to the base unit and is heated by conduction of the warm or hot effluent water coming from the showerhead, landing on the top plate of the base unit and being slowly released from the drain. The cold water from the shower, in its closed loop, returns to the mixing valve and enters the mixing chamber—resulting in a pre-heated water stream that reduces the energy required during the duration of a shower session.

In one embodiment of the present invention, a waste-water heat-recovery system for absorbing heat from an effluent water stream and for use in a residential bathtub or shower basin comprises: a heat-recovery device adapted to position in the bathtub or on the basin, the heat recovery device further comprising a top plate coupled to a base unit, the top plate comprising a plurality of inlet holes adapted to direct the effluent water to the base unit, the base unit further comprising a plurality of dividers cooperating to form corresponding channels adapted to accumulate the effluent water stream, the dividers further comprising a low-capacity drain element along a bottom edge and an overflow diverter located along a top edge whereby the channels adapt to allow fluid flow of the effluent stream to a drain control mechanism coupled to the base unit and adapted to release the water from the system.

Optionally, this system further includes dividers that have a closed-loop fluid reservoir means comprising generally hollow and elongated tubing element adapted to create a closed-loop fluid path and further adapted to encapsulate a fluid to enhance heat transfer from the effluent stream to the system.

And, the system further includes a mixing valve comprising a valve-body insert adapted to fit inside the faucet, the valve body comprising a mixing chamber and a cold-water bypass chamber forming a fluid path through the valve body insert; and an annular flow-ring assembly adapted to concentrically surround and rotatably couple to the mixing valve, the annular flow-ring assembly comprising a first chamber in fluid communication with the cold-water bypass chamber of the mixing valve and a second chamber in fluid communication with the mixing chamber of the mixing valve.

The annular flow-ring assembly further includes a one-way spring valve located intermediate to the first and second chambers, the spring valve enabling fluid flow from the first chamber to the second chamber. And, the annular flow-ring assembly further includes a first valve mechanism and a second valve mechanism, the first valve mechanism adapted to be in fluid communication with the first chamber and the first valve mechanism adapted to selectively direct cold-water to a cold-water diverted out transfer means; and the second valve mechanism adapted to be in fluid communication with the second chamber.

In one embodiment, the system further includes a cold-water diverter-conduit means in fluid communication with the first valve mechanism and adapted to transfer cold water from the first chamber to the heat-recovery device having a closed-loop fluid reservoir means comprising generally hollow and elongated tubing element adapted to be in fluid communication with the cold-water diverter-conduit means; and a return conduit means in fluid communication with the second valve mechanism and adapted to return heated water from the heat-recovery device to the mixing chamber, the return conduit means further adapted to be in fluid communication with the closed-loop fluid reservoir means, the closed-loop fluid path further adapted to enhance heat transfer from the effluent stream to the system.

In another possible embodiment of the present invention, an effluent water heat-recovery unit consists of a top plate having a plurality of inlet holes; a base unit having a plurality of conduits in fluid communication with the plurality of inlet holes, the inlet holes and conduits cooperating to enable the transfer and collection of the effluent water, the conduits further adapted to enable heat transfer from the effluent water to the heat-recovery unit; and the base unit further comprising an internal drain port adapted to selectively release the effluent water from the unit.

In yet another possible embodiment, a mixing-valve insert for a water faucet, the insert includes a generally cylindrical and hollow valve body adapted to form a first chamber for mixing hot and cold water, the valve body having a cold-water inlet adapted to be in fluid communication with a supply of cold water, a hot-water inlet adapted to be in fluid communication with a supply of hot water, an outlet for discharged mixed hot and cold water from the valve body, and a second chamber for bypassing cold water from the cold-water inlet, discharging cold water via a diverter outlet, and a diverted water inlet whereby the cold-water inlet, the second chamber and the diverter outlet forming one fluid path; and the valve body insert further being adapted to releasably and selectively couple to a flow-ring assembly; the flow-ring assembly comprising a diverter inlet assembly adapted to be in fluid communication with the diverter outlet whereby a fluid-flow path enables cold water to flow from the cold water supply to the flow-ring assembly, the flow-ring assembly further comprising a diverter-outlet assembly adapted to be in fluid communication with the diverter inlet whereby the fluid-flow path continues back into the first chamber of the valve-body insert.

Additionally, the flow-ring assembly further includes a diverted-water supply line in fluid communication with a heat recovery unit and a diverted-water return line in fluid communication with the heat recovery unit whereby a fluid flow path is created from the cold-water supply to the heat recovery unit to enable heat transfer of the cold-water and the fluid flow path returning to the first chamber of the mixing valve via the flow-ring assembly.

DRAWING

DESCRIPTION OF THE INVENTION

Figure 1:
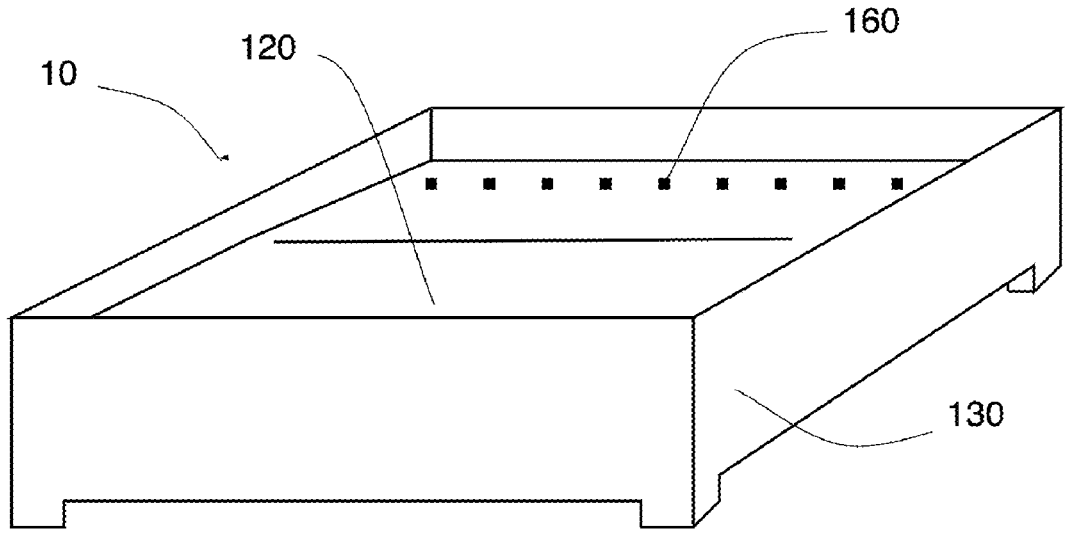
FIG. 1 is a front perspective view of one embodiment according to the present invention.
Figure 2:
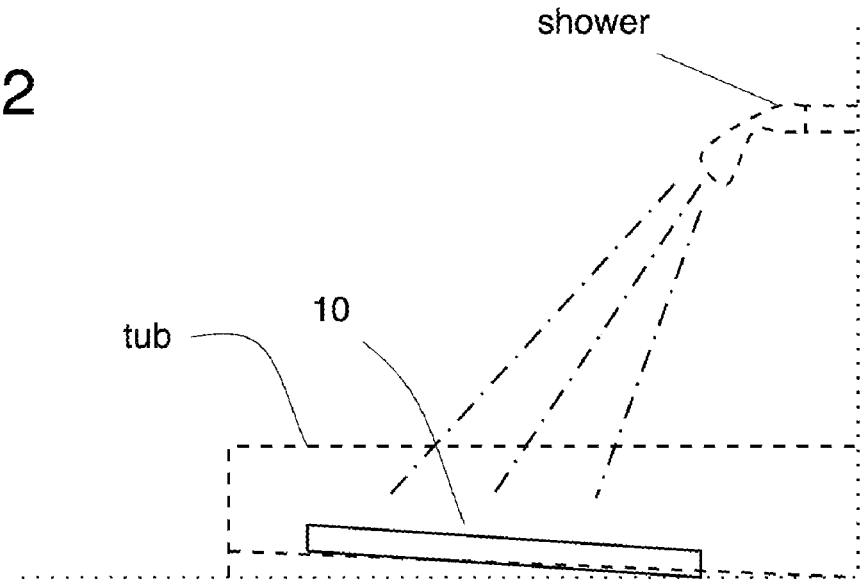
FIG. 2 illustrates a possible application of one embodiment of the present invention.

The present invention described herein by exemplary embodiments and represented in the various figures. In some figures certain components may be omitted for clarity. And, it should be understood that alternative components, additional components, or substitution of components, systems, or their equivalents would still fall into the scope and spirit of the invention.

FIGS. 1-5 illustrate one embodiment of the present invention, a device 10 designed and sized fit in a standard shower unit or bathtub. A user simply places the device 10 in the tub or shower and stands or sits on the device during showering or bathing. Accordingly, the device 10, a heat recovery unit or wastewater heat recovery unit includes a top plate 120 suitable for standing or sitting and may include a non-slip or other friction increasing surface suited for use in the shower. The top plate is generally flat and has a plurality of inlet holes 160 placed about the perimeter. The series of inlet holes 160 are arranged in two rows on two opposite edges of the top plate. And, the plate and inlet holes cooperate to direct the effluent stream of shower water to the attached base unit 130. A series of cooperating slow drains 150 ensures that water completely exits the device between uses and enables easy cleaning of the device.

Alternative forms of the top plate 120 would work equally well. For example, the top plate may be canted slightly at the center, as illustrated in FIG. 1. This design facilitates directing the effluent water. However, as many tubs and shower units already have a cant toward a floor drain, the canted top plate may not be necessary for appropriate directing and draining of the effluent water stream.

Figure 3:
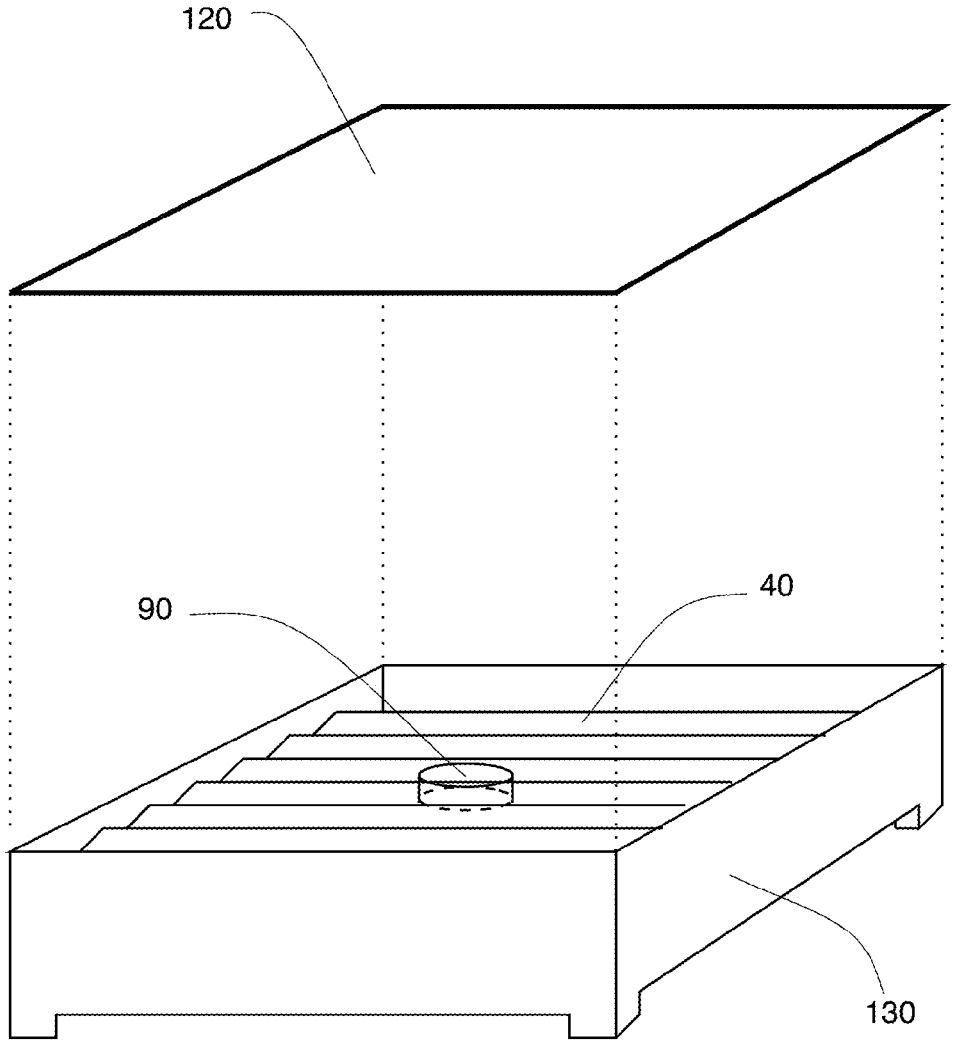
FIG. 3 is an assembly view of components of the embodiment of FIG. 1.
Figure 4:
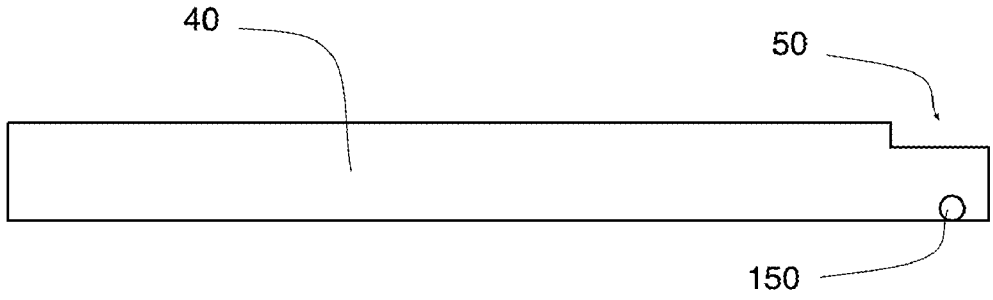
FIG. 4 is a side view of one component of the embodiment of FIG. 1.
Figure 5:
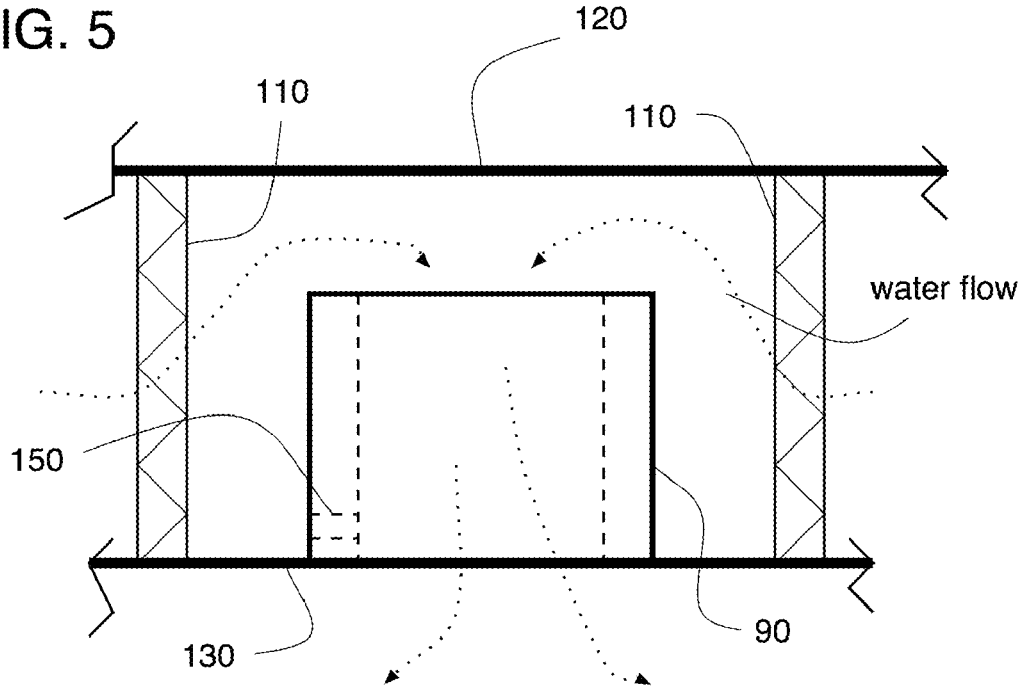
FIG. 5 is a partial detail view of certain components of the embodiment of FIG. 1.

The purpose of the drain holes is to divert the effluent water stream inside the base unit 130 where a number of generally parallel dividers form a series of channels that trap the hot water. FIG. 3 illustrates a possible arrangement of dividers 40 that trap hot water. FIG. 4 details a possible configuration of a divider 40. The divider includes a small, low-capacity drain element 150 at a bottom edge and a larger, overflow diverter 50 at a top edge.

Thus, as warm or hot effluent water (from the shower head, for example) enters the base unit 130 via the inlet holes 160 provided along opposite, outer edges of the top plate 120, each channel fills with the hot effluent water at a rate that outpaces the drain rate of the low-capacity drain element 150. Accordingly, when the water level reaches the overflow diverter 50, the water spills into the next channel. The low capacity drain elements 150 enable the device to discharge water over time.

Ultimately, the water flows from channel to channel until it arrives at the drain control mechanism 90 and the water exits the system. As a location convenient for maintenance access, one or more filter elements 110 insert in the internal water stream to capture particles, such as human hair, prior to entering the series of channels or prior to exiting the device.

As hot water falls from a shower, for example, and enters the device 10, the water cools and transfers its heat to the device. Accordingly, the device is fabricated from a material suited for such heat transfer, for example aluminum, copper, or other material for absorbing heat energy. In one embodiment the material is aluminum, and is preferably made from recycled aluminum. The device acts as a heat sink for the hot wastewater. The drain rates of the device ensure that the hot water transfers sufficient heat to the device as the water passes through the device. And, because the device acts as a heat sink, it will radiate the warmth for some considerable time after the water supply terminates. In this way a homeowner may capture heat from—what would otherwise be wasted hot water—exiting the drain.

The channel dividers can be made of the same material as the base unit, for example, aluminum. The dividers can be attached or coupled to the base by rivets, spot welds, seam welds, glues, or may be extruded, molded, cast, forged, stamped, or otherwise formed from a unitary piece of material. In one embodiment, the dividers 40 are made from tubing and filed with a liquid such as a mixture of bleach and water. The sealed tubes act as a heat sink.

The dividers 40 are arranged in an alternating pattern in the base 130 so that the diverters 50 form a serpentine path for the water to follow.

Optionally, the drain 90 may include a mechanism that controls the release of water. One such mechanism is a slow drain 150. Another mechanism may be connected to a simple timing device—maintaining the drain closed for some selectively adjustable time prior to opening. Alternatively, the mechanism may be manually operated as desired. In one embodiment, the mechanism includes a temperature-sensing element that opens and shuts the drain 90 as determined by pre-determined temperature set points. For example, the drain 90 may include a temperature control spring and a slow drain 150.

The channel dividers 40 are modular in design so different size showers can be fitted with the heat recovery unit 10 as required. Multiple channel sections can be combined as the desired size restrictions dictate.

In one embodiment of the present invention, a heat recovery system 10 includes a 2-foot wide by 2-foot deep by 2-inch high unit fabricated from aluminum. The channel dividers are made of 2-inch by 1-inch aluminum tubing filled with a mixture of water and bleach to act as a heat sink. The top plate holds the tubing in place by bolting through the top plate and bottom unit. And, because it is designed for use in the shower, the device includes rubber (or other high-friction material) feet to fix the device in one position in the tub or shower basin and provides protection to both the device and the tub or shower basin. Then, the user stands on the top plate during a shower. The use of a sanitized tablet can reduce the cleaning frequency. This system is easy to manufacture, economical to produce, simple and easy to install and use, and enables energy and cost savings that will be well-appreciated by both homeowners and business-owners alike.

Although this invention has been scaled for home use, the concepts could equally and readily be adapted for larger scale commercial and industrial use. A second embodiment of the present invention contemplates a household use for recovering heat from the wastewater discharge from a dishwasher or a washing machine.

In one embodiment the device can be wall mountable, for example, behind a washing machine to capture heat as the machine discharges warm or hot water.

Figure 6:
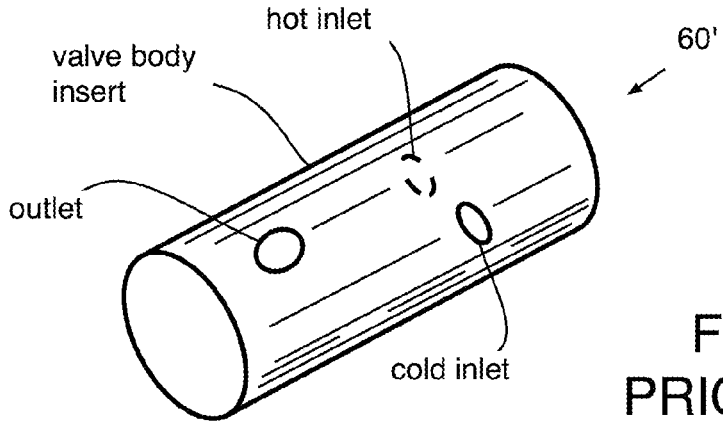
FIG. 6 PRIOR ART
FIG. 6 is a perspective side-view of a prior art mixing valve insert.
Figure 7:
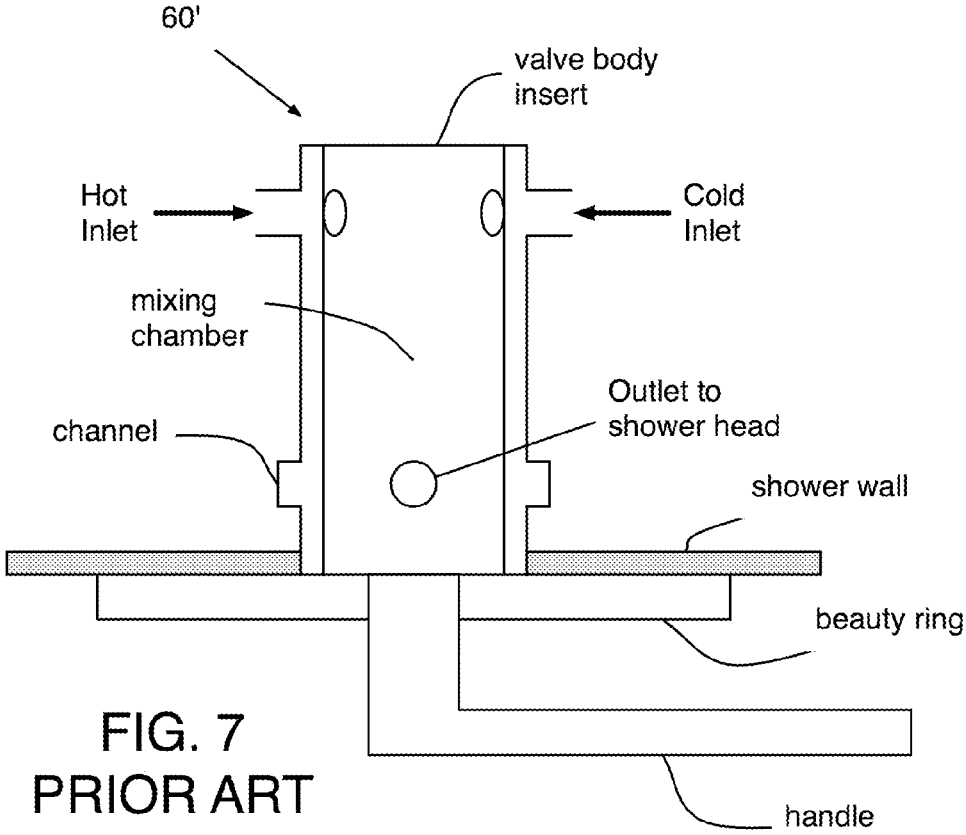
FIG. 7 PRIOR ART
FIG. 7 shows the prior-art mixing valve of FIG. 6 in a possible environment of use.

FIGS. 6 and 7 show a typical mixing valve insert 60' of a common shower or bathtub mixing-valve well understood in art. The prior-art mixing valve insert 60' includes a hollow, generally cylindrical valve body insert made of brass or other suitable metal or plastic. The valve body includes a hot-water inlet and a cold-water inlet each passing through the valve body to enable water to reach a mixing chamber defined by the interior of the valve body wall. Both hot water and cold water lines direct a supply of the hot and cold water, respectively, to the mixing valve. A hot-water supply channel and a corresponding cold-water supply channel locate concentrically around the mixing valve insert 60'. Each channel directs hot or cold water to the mixing valve interior mixing chamber as the valve body insert rotates from about zero degrees to about 179 degrees in rotation. This rotation exposes or covers the respective inlet.

The valve body further includes an outlet that enables mixed hot and cold water to discharge to either the showerhead or faucet. To facilitate this fluid transfer, a channel directs the mixed hot and cold water to a valve and the valve directs the flow to either the showerhead or faucet.

A wall-mount handle enables a person to rotate the valve body insert 60'. Accordingly, as the handle rotates from about zero degrees to about 180-degrees, a varying amount of hot and cold water from the corresponding supply lines enters the mixing chamber. In this manner, the person is able to adjust the effluent water temperature by retarding or increasing the flow of either the hot, or the cold water entering the mixing valve. Finally, for aesthetic purposes, an exterior-visible beauty ring, concentrically mounted to the handle, hides the valve body insert. Once removed, the beauty ring enable a person to replace or repair the valve body insert as required.

In one embodiment, the present invention takes advantage of existing bathroom fixtures and plumbing systems, including shower faucets as used in most residential applications, which are compatible with the standard mixing-valve insert 60' of the prior art. FIGS. 8-11 show a new, mixing-valve insert 60 made according to one embodiment of the present invention. The new mixing-valve insert 60, designed to fit inside existing fixtures, shares a common exterior, overall outer-diameter as the prior-art mixing-valve insert 60'.

Figure 8:
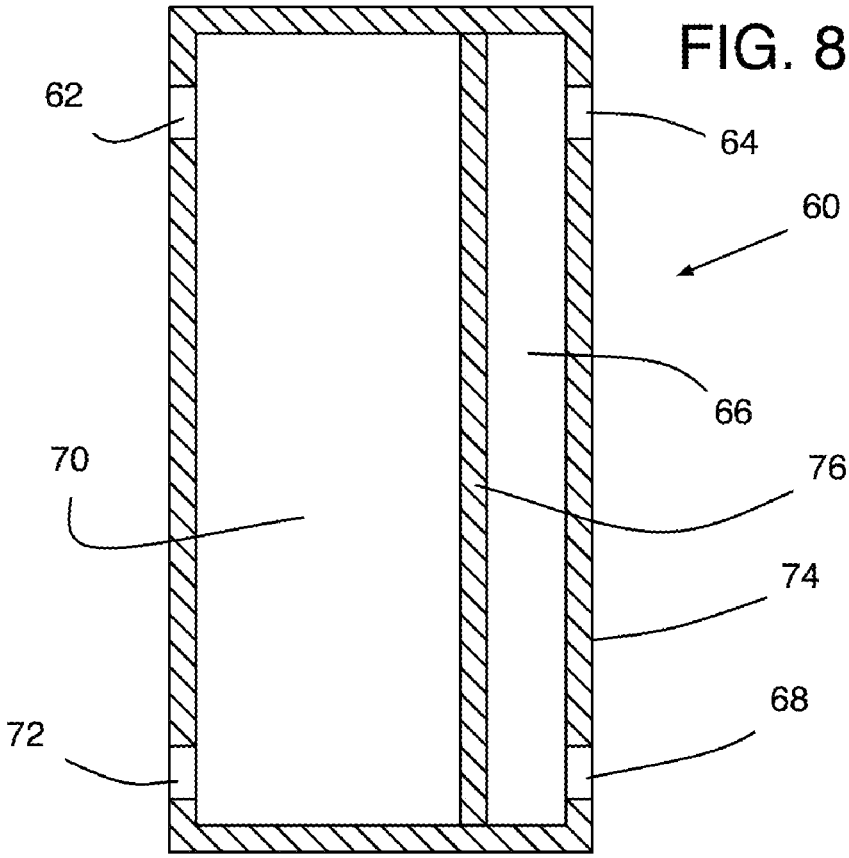
FIG. 8 is a top sectional view along of one embodiment of a mixing valve according to the present invention.
Figure 9:
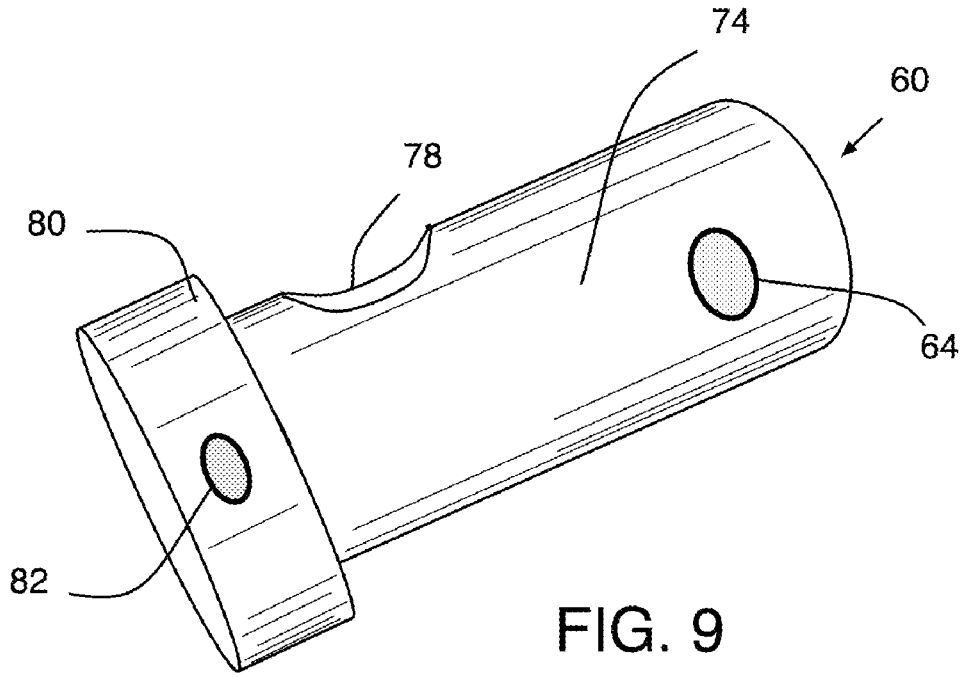
FIG. 9 is an off-set profile view of a mixing valve according to one embodiment of the present invention.

FIG. 8, a cross-sectional top view of the novel mixing valve insert 60, shows a generally cylindrical and hollow valve body 74 forming an interior mixing chamber 70. A portion of the interior of the valve body 74, however, is sub-divided to include a cold-water bypass chamber 66 formed by a portion of the interior side of the valve-body wall and a by-pass-chamber wall 76 running parallel to a long-side of the exterior valve body wall. The by-pass chamber 66 adapts to receive a supply of cold water via the cold water inlet 64, which operates similar to such cold-water inlets known in the prior art. From the by-pass chamber of FIG. 8, cold-water is diverted out of the mixing-valve insert via cold-water diverter outlet 68. This cold-water diverter outlet 68 serves additional purposes, which are further discussed, below.

The diverted water discharged from the cold-water diverter outlet 68 returns to the mixing valve insert 60 via diverted-water inlet 72. Thus, hot water entering the mixing chamber 70 via hot-water inlet 62 and diverted water mix. The resulting mixed water discharges from the mixing chamber via outlet 78 (illustrated in FIG. 9, for example), which operates and functions similar to the outlet valve of the prior-art mixing valve 60', and is well-understood in the art.

Figure 10:
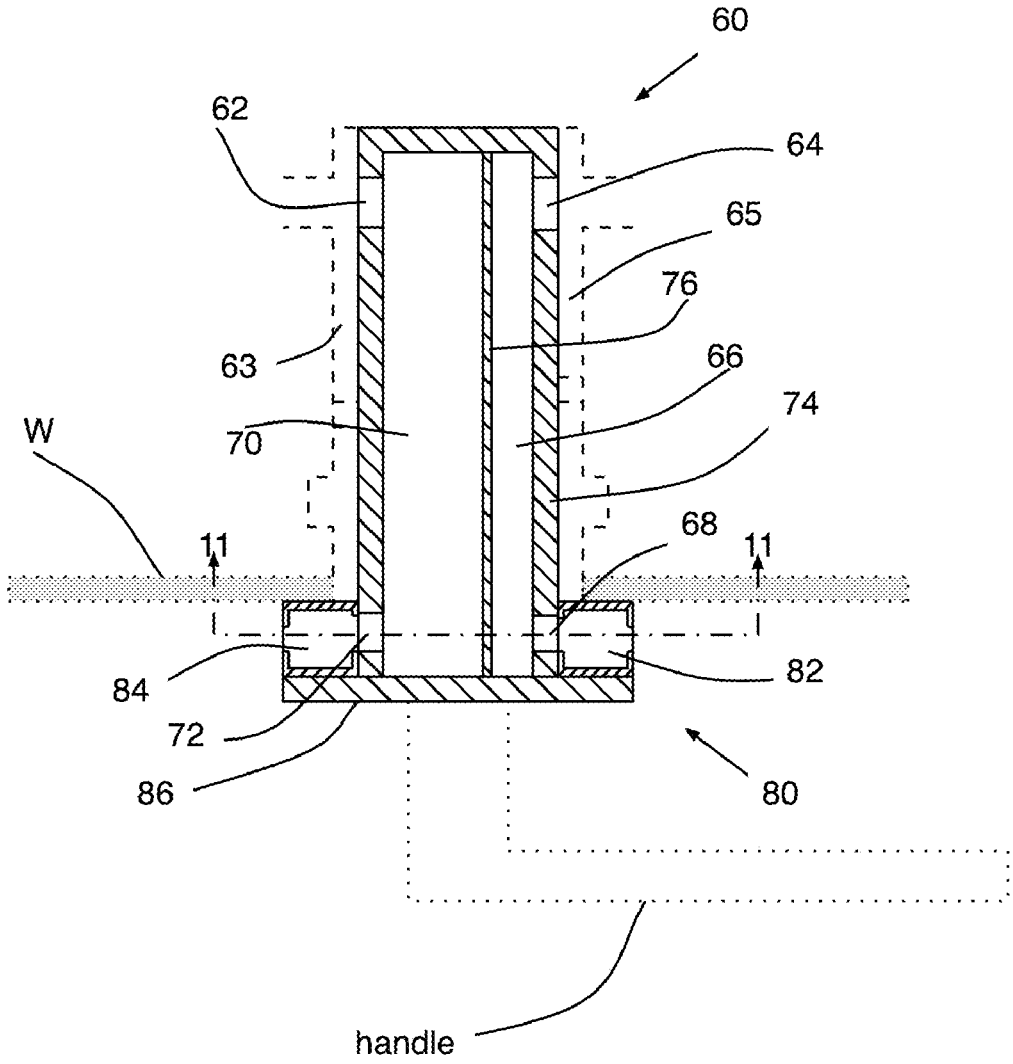
FIG. 10 is a top sectional view of the mixing valve of FIG. 9 along a centerline.

In one embodiment of the present invention, the mixing valve 60 includes a valve body 74 having a length longer than the prior-art valve 60', the novel mixing valve 60, although designed to be a direct replacement for existing mixing valves, has a valve body that extends beyond the mounting wall. FIG. 10 shows a bathroom wall (W) with the mixing valve 60 extending beyond the interior cavity of the wall, teaching away from the prior-art valve 60'. And, this extended, novel mixing valve 60 with an extended valve body 74 allows the cold-water diverter outlet 68 and diverted-water inlet 72 to remain exterior the wall cavity.

An annular flow ring assembly 80 adapts to concentrically surround and selectively couple to the mixing valve 60. The flow-ring assembly 80 includes an end-cap 86 adapted to receive a standard handle for enabling a person to mix hot and cold water as generally understood in the art. Thus, as the handle rotates, a coupling device between the handle and the mixing valve 60 transfers the rotary motion of the handle to a directly corresponding rotary motion of the valve body 74 while the flow ring 80 remains stationary relative to the wall. This enables a person to mix hot and cold water in a conventional manner. However, the flow of cold water follows a path that differs from the conventional valve 60' of the prior art, as will be further explained.

The end-cap 86 also secures diverter-outlet assembly 82 and diverter-inlet assembly 84. In one embodiment (as FIG. 10 shows), the flow ring 80 provides a direct channel between the cold-water diverter outlet 68 of the mixing valve 60 and the diverted-water inlet 72.

Figure 11:
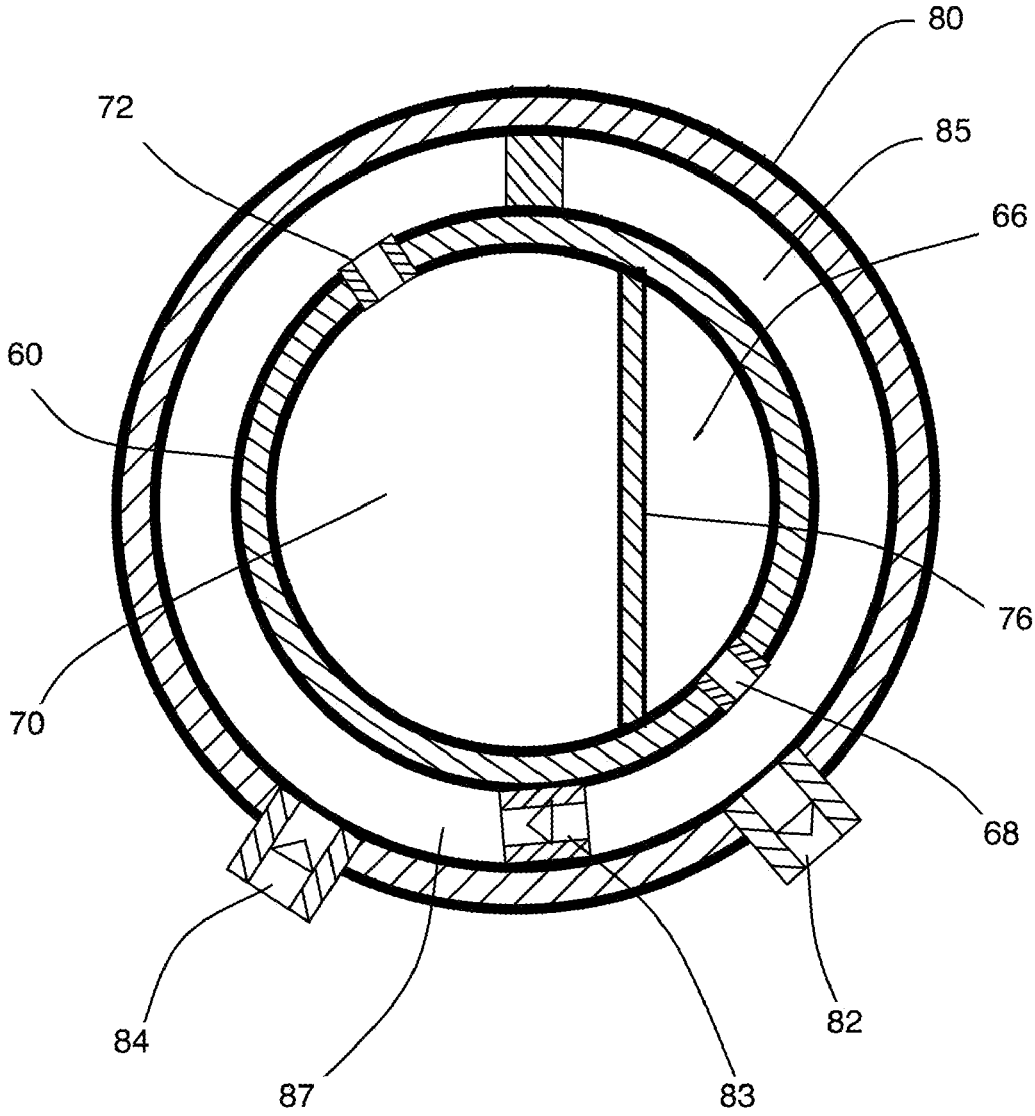
FIG. 11 is a cross-sectional front view of the mixing valve of along the line 11-11 of FIG. 10.

In one embodiment, as FIG. 11 shows, the flow-ring 80 includes a one-way spring valve 83 that, upon pre-set pressure conditions, enables fluid transfer from the cold-water-in diverter channel 85 to the diverted-water-return channel 87. A first, quick-connect-type valve 82 directs the flow of cold water out of the ring 80 via an external routing pipe, such as line 88. When the line 88 is not connected to the valve 82, the valve closes; and, with the line in place the valve opens. Similarly, a second, quick-connect-type valve 84 returns diverted water to the flow-ring 80; the valve 84 opens when the return line 89 is connected. This enables a closed-loop system for the directing of cold water to the heat-recovery unit 10 and back to the mixing valve 60. Accordingly, this configuration allows selectable use of the heat recovery unit 10 without having to replace the flow-ring 80 and mixing valve 60.

The spring valve, in an alternative embodiment (not illustrated), includes external adjustment that enables a person to alter the pre-set pressure level at which point the spring valve opens to adjust to varying water pressures likely to be encountered in various installations.

Figure 12:
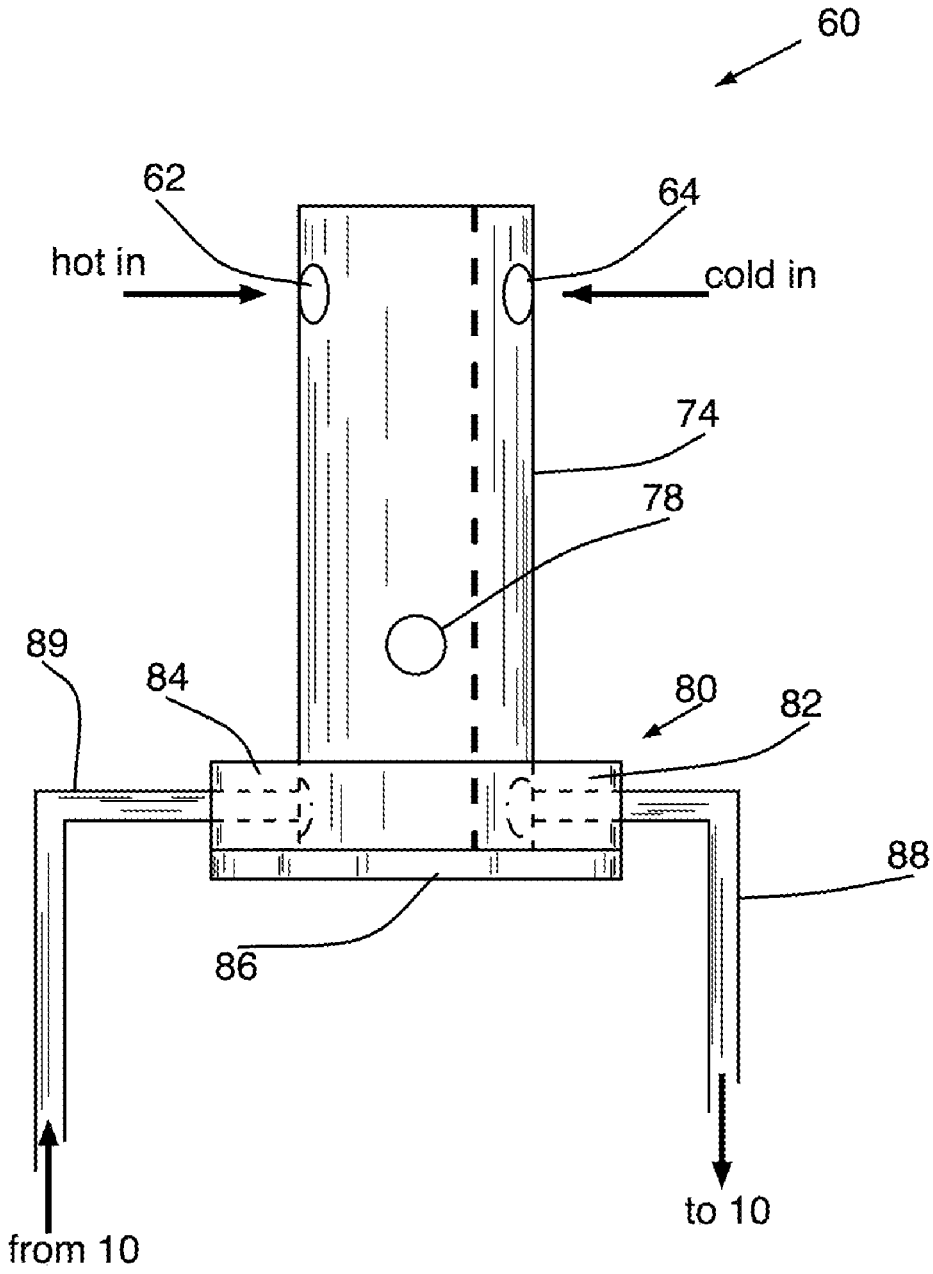
FIG. 12 is a top view of a mixing valve according to one embodiment of the present invention.
Figure 13:
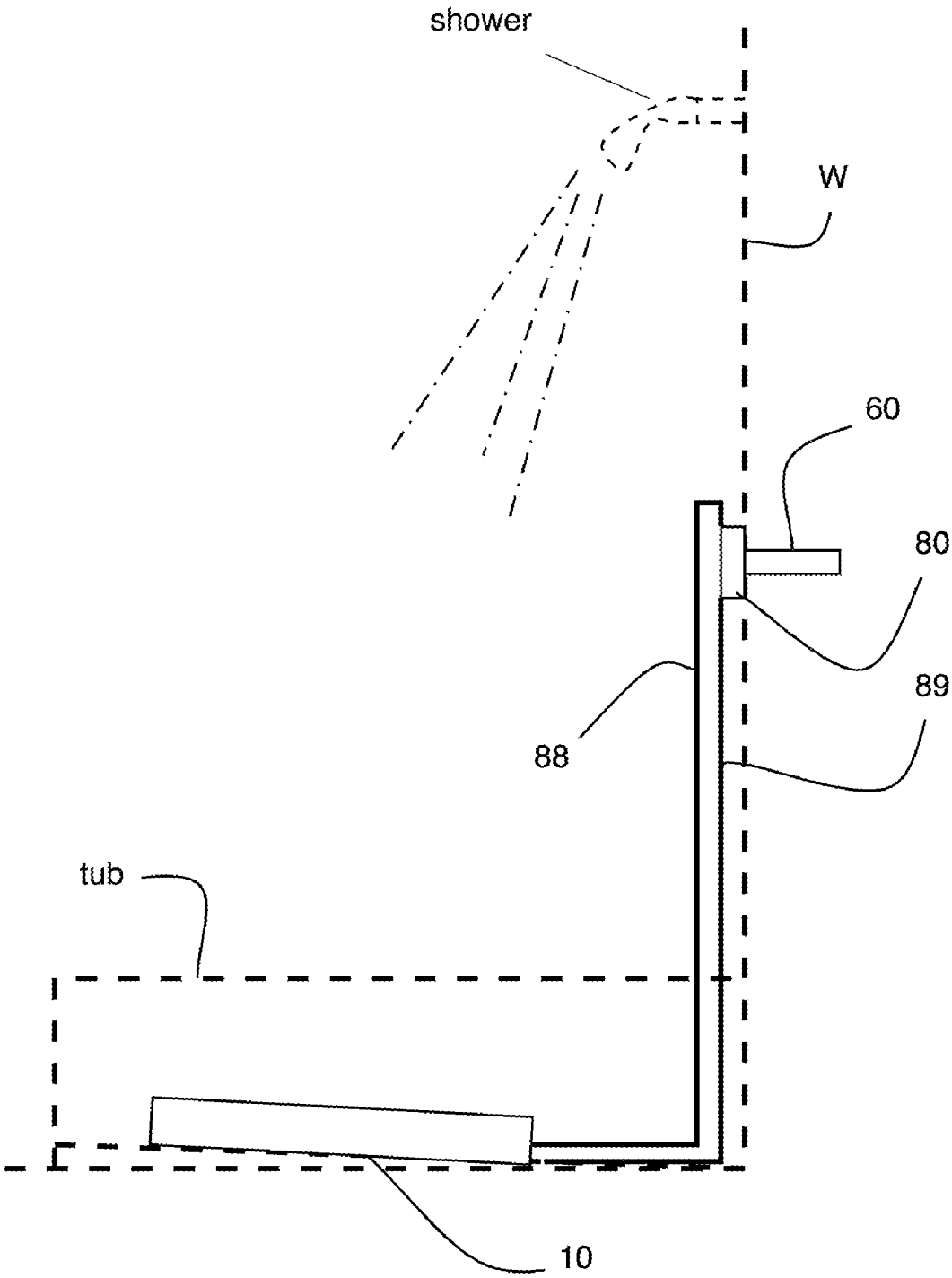
FIG. 13 is a schematic diagram showing one embodiment of the present invention in relationship to a possible environment of use.

However, in one embodiment, as FIGS. 12 and 13 show, the annular flow-ring 80 adapts to selectively couple to a diverter-out line 88 and a diverter-in line 89. The diverter-out line connects to the base unit 130, thus directing cold water through the mixing valve by-pass chamber 66 via the cold-water diverter outlet 68, then through the diverter-outlet assembly 82 of the flow-ring 80 and into the diverter-out line 88. At an opposite end, the diverter-out line selectively and releasably couples to the heat recovery unit 10. Ideally, a closed loop system comprising a serpentine and continuous tube made from copper tubing nests in the base unit 130 to enable heat transfer from the effluent warm water stream as it flows from the top of the base unit to the drain. The diverted cold-water in this closed loop system ultimately enters the return line, or divert-in line 89 having one end coupled to the heat recovery unit 10 and a second end releasably and selectively coupled to the flow-ring via diverter-inlet assembly 84, which in turn is in fluid connection with the mixing chamber 70 via diverted-water inlet 72.

One advantage of forcing water to follow the convoluted and diverted flow-path from the cold-water supply through the heat recovery unit 10 includes a reduction in energy consumption as waste water now pre-heats the diverted cold-water before entering the mixing chamber 70. Thus, as a person takes a shower, the demand on the hot water supply progressively lessons during the duration of the shower.

As FIG. 11 shows, the flow ring assembly adapts to selectively couple to the mixing valve 60. Accordingly, a home-owner can readily alternate from a standard shower utilizing the novel system shown in FIG. 10. In this form, the mixing valve 60 and flow-ring assembly 80 simply re-route the cold water with out sending the cold-water flow to the heat recovery unit 10. The heat recovery unit can still be used to capture the stream of shower water and radiate heat back into the bathroom. Alternatively, for example during warmer summer months, the home-owner may elect to remove the heat recovery unit 10 from the bath enclosure and shower normally.

However, should the home-owner wish to pre-heat the cold water while at the same time utilize the heat-recovery properties of the heat recovery unit 10, a second flow-ring assembly, as FIG. 12 shows, readily and selectively couples to the mixing valve 60. In the embodiment of FIG. 12, the cold water is sent to the heat recovery unit (see FIG. 13) where it is heated by the discharged shower water, and the water is returned to the mixing valve 60 via return line 89, as previously discussed.

This disclosure is not intended as limiting. Instead, exemplary embodiments of the present invention were described so that those having ordinary skill in the art may better appreciate the intent and spirit of the invention. The invention is limited only by the proper construction of the following claims.

I claim:

1. A waste-water heat-recovery system for absorbing heat from an effluent water stream and for use in a residential bathtub or shower basin, the system comprising:

a heat-recovery device adapted to position in the bathtub or on the basin, the heat recovery device further comprising a top plate coupled to a base unit, the top plate comprising a plurality of inlet holes adapted to direct the effluent water to the base unit, the base unit further comprising a plurality of dividers cooperating to form corresponding channels adapted to accumulate the effluent water stream to a drain control mechanism coupled to the base unit and adapted to release the water from the system, wherein the dividers further comprise a low-capacity drain element along a bottom edge and an overflow diverter located along a top edge whereby the channels adapt to allow fluid flow of the effluent stream, and a closed-loop fluid reservoir means comprising a generally hollow and elongated tubing element adapted to create a closed-loop fluid path and further adapted to encapsulate a fluid to enhance heat transfer from the effluent stream to the system, wherein the bathtub or shower basin further includes a faucet, the system further comprising:

a mixing valve comprising a valve-body insert adapted to fit inside the faucet, the valve body comprising a mixing chamber and a cold-water bypass chamber forming a fluid path through the valve body insert; and an annular flow-ring assembly adapted to concentrically surround a portion of the mixing valve and rotatably couple to the mixing valve, the annular flow-ring assembly comprising a first chamber in fluid communication with the cold-water bypass chamber of the mixing valve and a second chamber in fluid communication with the mixing chamber of the mixing valve, wherein the annular flow-ring assembly further comprises a first valve mechanism and a second valve mechanism, the first valve mechanism adapted to be in fluid communication with the first chamber and the first valve mechanism adapted to selectively direct cold-water to a cold-water diverted out transfer means; and the second valve mechanism adapted to be in fluid communication with the second chamber, wherein a cold-water diverter-conduit means in fluid communication with the first valve mechanism and adapted to transfer cold water from the first chamber to the heat-recovery device having a closed-loop fluid reservoir means comprising generally hollow and elongated tubing element adapted to be in fluid communication with the cold-water diverter-conduit means; and a return conduit means in fluid communication with the second valve mechanism and adapted to return heated water from the heat-recovery device to the mixing chamber, the return conduit means further adapted to be in fluid communication with the closed-loop fluid reservoir means, the closed-loop fluid path further adapted to enhance heat transfer from the effluent stream to the system.

2. The system of claim 1 wherein the annular flow-ring assembly further comprises a one-way spring valve located intermediate to the first and second chambers, the spring valve enabling fluid flow from the first chamber to the second chamber.

* * * * *